US009016538B2

(12) United States Patent
Ramsden

(10) Patent No.: US 9,016,538 B2
(45) Date of Patent: Apr. 28, 2015

(54) CORNER DEVICE AND CORNER DEVICE ATTACHMENT KIT

(76) Inventor: Charles Dale Ramsden, Johannesburg (ZA)

( * ) Notice: Subject to any disclaimer, the term of this patent is extended or adjusted under 35 U.S.C. 154(b) by 1496 days.

(21) Appl. No.: 11/632,520

(22) PCT Filed: Jun. 21, 2005

(86) PCT No.: PCT/IB2005/001745

§ 371 (c)(1),
(2), (4) Date: Aug. 21, 2007

(87) PCT Pub. No.: WO2006/011010

PCT Pub. Date: Feb. 2, 2006

(65) Prior Publication Data

US 2008/0295303 A1 Dec. 4, 2008

(30) Foreign Application Priority Data

Jul. 21, 2004 (ZA) ..... 2004/5806

(51) Int. Cl.

| | |
|---|---|
| ***B25C 5/02*** | (2006.01) |
| ***B42B 4/00*** | (2006.01) |
| ***B25C 7/00*** | (2006.01) |
| ***B42B 7/00*** | (2006.01) |
| ***G09F 3/03*** | (2006.01) |
| *B42F 1/12* | (2006.01) |

(52) U.S. Cl.

CPC ... *B42B 4/00* (2013.01); *B25C 7/00* (2013.01); *B42B 7/00* (2013.01); *B42F 1/12* (2013.01); *G09F 3/03* (2013.01)

(58) Field of Classification Search

USPC ..... 227/19, 76, 134, 156, 128, 124, 120, 227/151; 24/7, 67 CF; 281/42, 15.1, 28

See application file for complete search history.

(56) References Cited

U.S. PATENT DOCUMENTS

| | | | | |
|---|---|---|---|---|
| 214,347 | A | | 4/1879 | Ayres |
| 305,040 | A | | 9/1884 | Ball |
| 355,822 | A | | 1/1887 | Humbert |
| 447,396 | A | | 3/1891 | Worthington |
| 472,436 | A | | 4/1892 | Cornelius |
| 524,647 | A | | 8/1894 | Pancoast |
| 769,313 | A | | 9/1904 | Higgs |
| 784,205 | A | * | 3/1905 | CirJean ..... 281/18 |
| 1,146,591 | A | | 7/1915 | Niedomanski |

(Continued)

FOREIGN PATENT DOCUMENTS

| | | |
|---|---|---|
| DE | GB 558609 | 1/1944 |
| DE | GB 2252748 | 10/1972 |

(Continued)

*Primary Examiner* — Hemant M Desai
*Assistant Examiner* — Nathaniel Chukwurah
(74) *Attorney, Agent, or Firm* — Frommer Lawrence & Haug LLP; Ronald R. Santucci

(57) ABSTRACT

A corner device (10) having a main body (12) for carrying information or an ornamental pattern on an upper surface and locating formation (14) extending from one end of the main body. The locating formation locates and aligns the corner device with respect to an article before attaching the corner device to the article. The locating formation is shaped to receive the legs of a staple on either side thereof. The device also includes a folding area adapted to allow the main body to be folded over the locating formation once the corner device has been attached to the article, thereby to display the information or ornamental pattern.

19 Claims, 4 Drawing Sheets

(56) References Cited

U.S. PATENT DOCUMENTS

| | | | | | |
|---|---|---|---|---|---|
| 1,423,520 | A | | 7/1922 | Freedman | |
| 1,637,832 | A | | 8/1927 | Miller | |
| 1,811,116 | A | * | 6/1931 | Engel | 40/778 |
| 1,921,213 | A | | 8/1933 | Bush et al. | 129/16.7 |
| 2,460,650 | A | | 2/1949 | Nemeth | 24/67 |
| 2,543,144 | A | | 2/1951 | Wold | 24/153 |
| 2,728,451 | A | | 12/1955 | Leander | 206/60 |
| 2,897,500 | A | | 8/1959 | Lang | 1/2 |
| 3,915,366 | A | | 10/1975 | Mitchell | 227/83 |
| 4,087,035 | A | | 5/1978 | Harmon | 227/120 |
| 4,129,059 | A | | 12/1978 | Van Eck | 85/49 |
| 4,168,794 | A | | 9/1979 | Nishioka | 227/155 |
| 4,180,197 | A | * | 12/1979 | Raasch et al. | 227/120 |
| 4,182,474 | A | * | 1/1980 | Sato | 227/99 |
| 4,235,031 | A | | 11/1980 | Aguilar | 40/360 |
| 4,382,326 | A | | 5/1983 | Rabuse | 29/270 |
| 4,571,107 | A | | 2/1986 | Takada | 402/14 |
| 4,574,992 | A | | 3/1986 | Holman | 227/83 |
| 4,619,394 | A | | 10/1986 | Knispel et al. | 227/156 |
| 4,731,917 | A | | 3/1988 | Krowl | 29/432 |
| 4,732,107 | A | | 3/1988 | Jacobsen | 116/237 |
| 4,770,335 | A | | 9/1988 | Wingert | 227/139 |
| 4,898,316 | A | | 2/1990 | McLaughlin et al. | 227/120 |
| 5,014,896 | A | | 5/1991 | Reitmeier et al. | 227/39 |
| 5,014,897 | A | | 5/1991 | Uuskallio | 227/119 |
| 5,056,825 | A | | 10/1991 | Templet | 283/36 |
| 5,217,256 | A | | 6/1993 | Lomas | 281/20 |
| 5,272,792 | A | | 12/1993 | Harper | 24/67 |
| 5,421,502 | A | | 6/1995 | Huang | 227/134 |
| 5,570,906 | A | | 11/1996 | Giulie | 281/42 |
| 5,595,336 | A | | 1/1997 | Everdyke | 227/7 |
| 5,626,366 | A | * | 5/1997 | Lee | 281/20 |
| 5,645,567 | A | * | 7/1997 | Crainich | 606/219 |
| 5,660,315 | A | | 8/1997 | Beavers et al. | 227/156 |
| 5,692,666 | A | | 12/1997 | Dallas | 227/154 |
| 5,692,667 | A | | 12/1997 | Chi | 227/151 |
| 5,725,141 | A | | 3/1998 | Chi | 227/109 |
| 5,797,625 | A | | 8/1998 | Giulie | 281/42 |
| 5,845,835 | A | | 12/1998 | Kim | 227/67 |
| 5,870,802 | A | | 2/1999 | Goldman | 24/67.9 |
| 5,918,790 | A | | 7/1999 | Donnell | 227/151 |
| 5,937,485 | A | | 8/1999 | Dittmer | 24/67 |
| 6,039,232 | A | | 3/2000 | Snover | 227/150 |
| 6,082,604 | A | | 7/2000 | Dennis | 227/8 |
| 6,173,949 | B1 | | 1/2001 | Visick et al. | 270/58.08 |
| 6,199,852 | B1 | | 3/2001 | Visick et al. | 270/58.08 |
| 6,257,477 | B1 | | 7/2001 | Strååt et al. | 227/119 |
| 6,349,868 | B1 | * | 2/2002 | Mattingly et al. | 227/134 |
| 6,609,647 | B1 | | 8/2003 | Lai | 227/120 |
| 6,676,002 | B2 | | 1/2004 | Jairam et al. | 227/154 |
| 6,736,304 | B2 | | 5/2004 | Mochizuki | 227/131 |
| 6,834,731 | B2 | * | 12/2004 | Burlingame et al. | 173/18 |
| 2003/0057697 | A1 | | 3/2003 | Duval | |
| 2003/0099102 | A1 | | 5/2003 | Duval | |

FOREIGN PATENT DOCUMENTS

| | | | | |
|---|---|---|---|---|
| EP | 1407898 | | 10/2003 | B42F 7/04 |
| JP | 11139059 | | 11/1997 | B42F 5/06 |
| JP | 11156754 | | 6/1999 | B25C 7/00 |
| JP | 2001322191 | A | 11/2001 | B31F 5/00 |
| JP | 2002265141 | | 9/2002 | |
| JP | 2003191673 | | 9/2003 | B42F 1/12 |
| NL | 1 017 399 | A | 8/2002 | |
| WO | WO 95/29069 | | 11/1995 | |
| WO | WO 02/44572 | | 6/2002 | F16B 15/08 |
| WO | WO 2004/014167 | | 2/2004 | A41H 37/04 |

* cited by examiner

Fig.4(a)
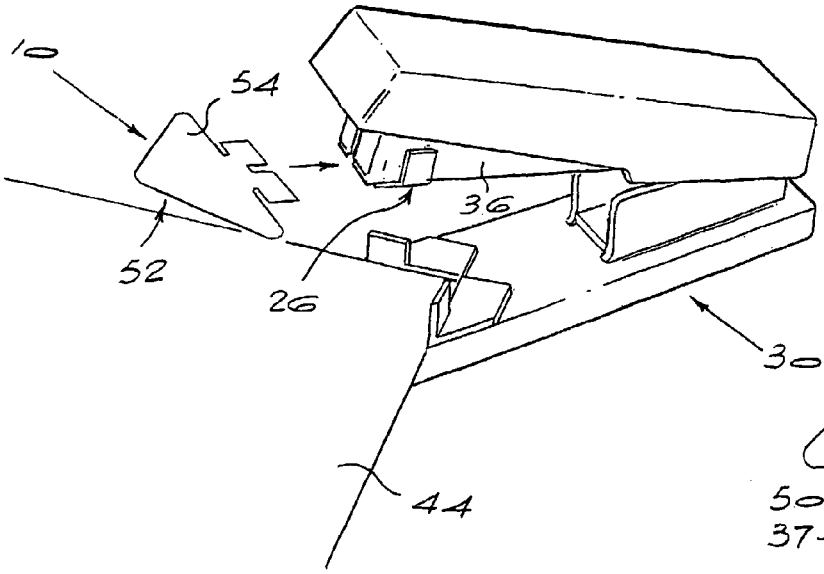
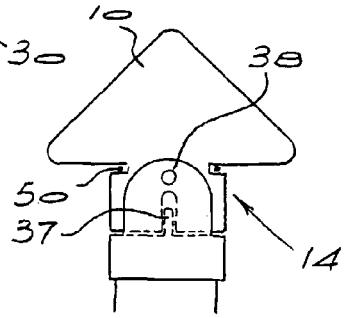
Fig.4(b)
Fig.5
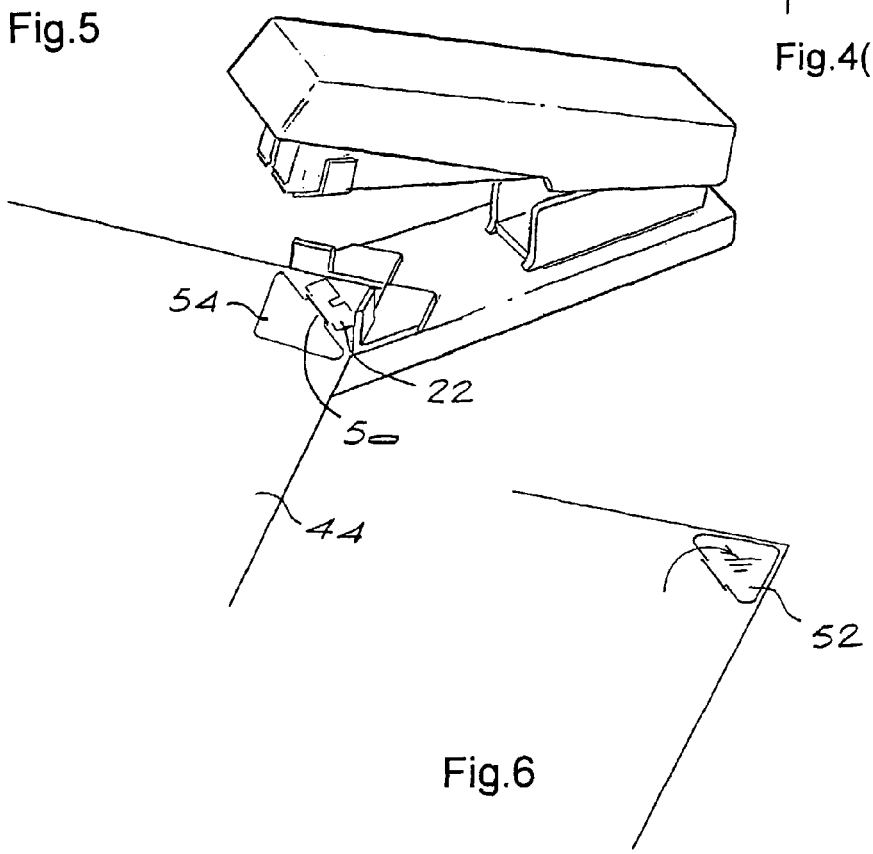
Fig.6

Fig.11
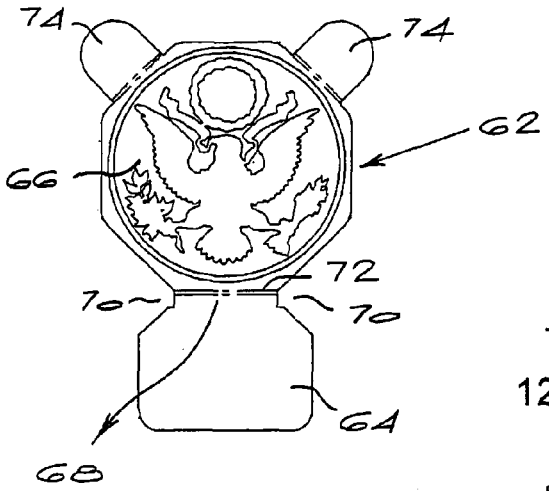
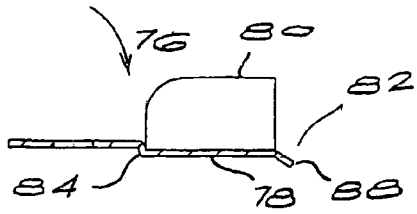
Fig.12(a)
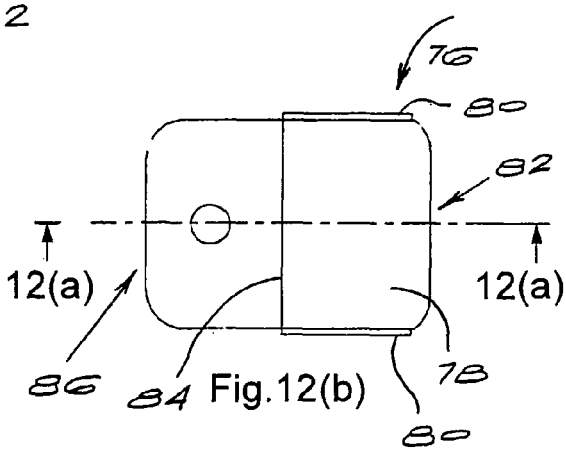
Fig.12(b)
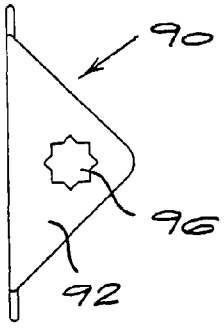
Fig.13(a)
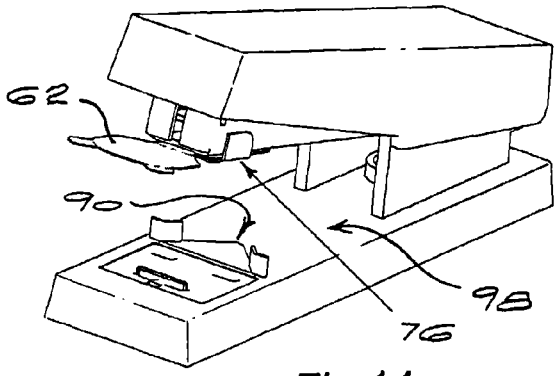
Fig.14
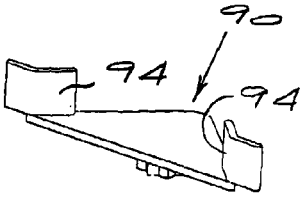
Fig.13(b)
Fig.15
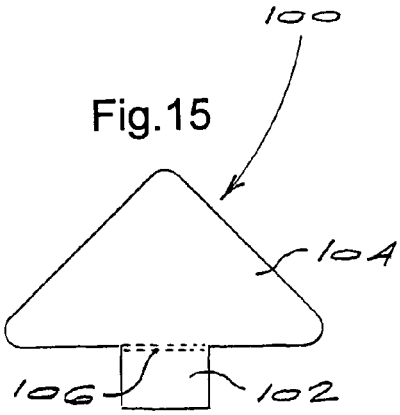

CORNER DEVICE AND CORNER DEVICE ATTACHMENT KIT

This application is a 371 of PCT/IB2005/001745 filed on Jun. 21, 2005, published on Feb. 2, 2006 under publication number WO 2006/011010 A1 and claims priority benefits of South African Patent Application No. 2004/5806 filed Jul. 21, 2004.

BACKGROUND OF THE INVENTION

THIS invention relates to a corner device to be attached to an article, such as a document formed by a sheet of paper or sheets of paper. This invention further relates to kit for attaching a corner device to a document and a corner device locator to align and hold the corner device before attaching it to the sheets of paper.

Staples are one of the most commonly used fasteners to secure sheets of paper together. As it is fairly easy to remove a staple which secures sheets of paper together, a need has arisen for a tamper evident device or seal to be applied with the staple, thereby to provide some security features to a document formed by the sheets of paper.

The use of a staple to secure sheets of paper together has the disadvantage that the corners of the sheets of paper typically discolour and curl upwards after the document has been used by a number of people or for an extended period of time. This may result in the document, especially in cases where it is a legal document, such as a contract, losing its aesthetic appeal and professional look.

It is an object of the present invention to provide a corner device that addresses at least some of these problems.

SUMMARY OF THE INVENTION

According to the present invention there is provided a corner device including

- a main body for carrying information or an ornamental pattern on an upper surface;
- a locating formation extending from one end of the main body for locating and aligning the corner device with respect to an article before attaching the corner device to the article, the locating formation shaped to receive legs of a staple on either side thereof in use; and
- a folding area adapted to allow the main body to be folded over the locating formation once the corner device has been attached to the article, thereby to display the information or ornamental pattern.

The locating formation may further comprise a neck connecting the locating formation with the main body, wherein a narrow channel is defined by the locating formation and the main body on either side of the neck, the channel in use receiving the legs of the staple.

Preferably the locating formation further includes two lobes defining a central locating slit which extends from an outer end of the locating formation towards the main body.

Advantageously the main body may have attachment means to secure a bottom surface of the main body to the article. The attachment means is preferably an adhesive layer applied to the bottom surface.

Typically the main body further includes at least one arm shaped and configured to extend radially outward from the main body, the at least one arm having a bottom surface to which an adhesive layer is applied, wherein, in use, the at least one arm is folded around a side of the article to attach to secure the arm to a back of the article. Preferably the main body includes two arms.

The information may preferably identify the article. The ornamental pattern may preferably be a company logo or emblem.

The main body may include a security apparatus, such as an electronic device.

Typically, the article comprises sheets of paper.

According to a second aspect of the present invention there is provided a kit for attaching a corner device as describe above to an article, the kit including a corner device locator, the corner device locator including a receiver portion for receiving the locating formation of the corner device and attachment means for attaching the corner device locator to a stapler, wherein the receiver portion defines a short channel that is located, in use, about the underside of a magazine of the stapler.

Preferably, the locator attachment means is two legs extending perpendicularly from either side of the receiver portion, the legs being biased towards each other to grip the magazine of the stapler.

The locator may further include a central securing formation on a front end of the receiver portion, with the securing formation being a protrusion.

Preferably the locator may include a stop to limit the movement of a corner device in the short channel. The stop may be a central internally protruding stop, which, in use, is received by the central locating slit of the corner device. Alternatively, the stop may be a step formation between a front end and a back end of the locator.

Typically the kit will also include a paper aligner, the paper aligner comprising two brackets defining a locating formation to receive and align the article with the stapler.

The paper aligner may include a formation to secure the paper aligner to the stapler.

According to a further aspect of the invention there is provided a corner device locator including a receiver portion and attachment means for attaching the corner device locator to a stapler, wherein the receiver portion defines a short channel that is located, in use, about the underside of a magazine of the stapler.

Preferably, the locator attachment means is two legs extending perpendicularly from either side of the receiver portion, the legs being biased towards each other to grip the magazine of the stapler.

The locator may further include a central securing formation on a front end of the receiver portion, with the securing formation being a protrusion.

Preferably the locator may include a stop to limit the movement of a corner device in the short channel. The stop may be a central internally protruding stop, which, in use, is received by the central locating slit of the corner device. Alternatively, the stop may be a step formation between a front end and a back end of the locator.

BRIEF DESCRIPTION OF THE DRAWINGS

FIG. 4*a* shows the insertion of the corner device of FIG. 1 into the corner device locator of FIG. 2;

FIG. 4*b* shows the inserted corner device of FIG. 1 inside the corner device locator of FIG. 2;

FIG. 5 shows the corner device of FIG. 1 attached with a staple to the sheets of paper;

FIG. 6 shows how the corner device of FIG. 1 is folded over itself into its operative position;

FIG. 11 shows yet a further example embodiment of the corner device according to the present invention, the main body of the corner device having a hectagonal shape;

FIG. 12*a* shows a cross-sectional side view of a further example embodiment of the corner device locator according to the present invention;

FIG. 12*b* shows a top view of the corner device locator of FIG. 12*a;*

FIG. 13*a* shows a bottom view of a further example embodiment of a paper aligner;

FIG. 13*b* shows a perspective view of the paper aligner of FIG. 13*a;*

FIG. 14 shows the corner device of FIG. 11 received by the corner device locator of FIGS. 12*a* and 12*b* to a stapler, which has the paper aligner of FIGS. 13*a* and 13*b* attached to the stapler; and FIG. 15 shows a yet a further example embodiment of the corner device locator according to the present invention.

DESCRIPTION OF PREFERRED EMBODIMENTS

Figure 1:
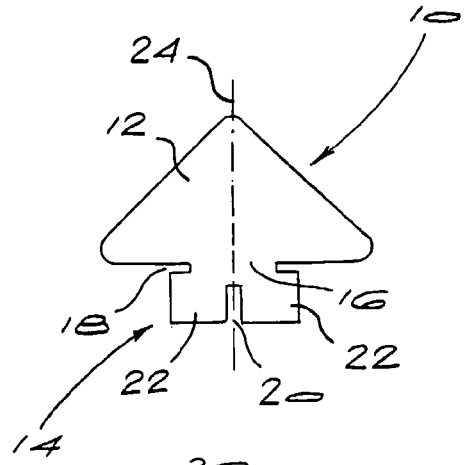
FIG. 1 shows a corner device according to an example embodiment of this invention, the corner device having a main body and a locating formation.

FIG. 1 shows a corner device 10 according to an example embodiment of the present invention comprising a main body 12 and a locating formation 14. In use, the corner device 10 is attached to an article, typically the corner of a document formed by a sheet of paper or sheets of paper. The main body 12 of the corner device 10 therefore has a substantially triangular shape to neatly fit over a corner of the sheets of paper once attached thereto. It will be appreciated that the corner device may have other shapes that may substantially cover the corner of a document, as illustrated by further example embodiments.

The locating formation 14 of the corner device 10 has a neck 16 connecting the locating formation 14 with the main body 12. On either side of the neck 16 a narrow channel 18 is defined by the locating formation 14 and the main body 12. A locating slit 20 extends centrally from the outer end of the locating formation 14 through the locating formation 14 towards the main body 12, dividing the locating formation 14 into two lobes 22. The configuration of the neck 16 and narrow channels 18 ensures that the distance between the two legs of a staple are greater than the width of the neck 16 thereby ensuring that the staple does not puncture the corner device 10.

In use the corner device 10 is secured to a sheet or sheets of paper with a staple. In this example embodiment of the invention the corner device 10 is attached to a corner of a sheet or sheets of paper at an angle of approximately 45° with a central axis 24 of the corner device 10. This alignment is preferable, especially in instances where the main body 12 is substantially triangular, as the installed corner device 10 would cover the corner of the sheets of paper. The process of aligning the corner device 10 with a document is described according to FIGS. 2 to 6 below.

Figure 2:
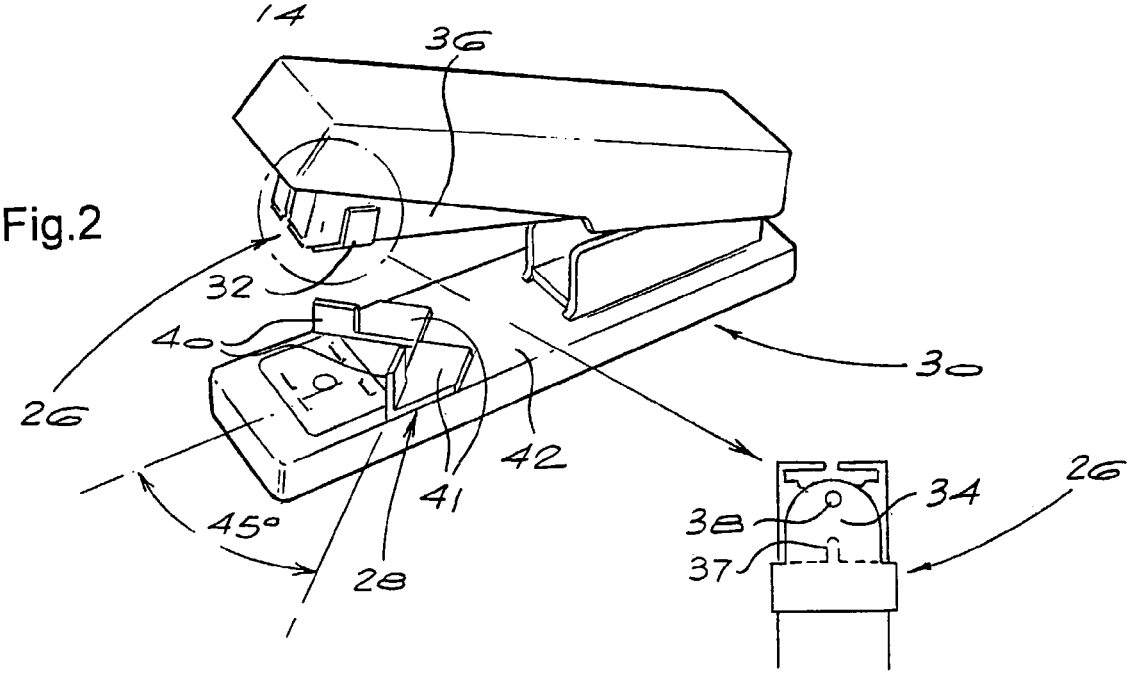
FIG. 2 shows a stapler with a corner device locator according to an example embodiment and a paper aligner secured to the stapler, with an insert detailing the features of the corner device locator.

Referring to FIG. 2, a corner device locator 26 and a paper aligner 28 are used to align and hold the corner device 10 in position before attaching the corner device 10 with a staple to the paper, thereby ensuring proper alignment of the corner device 10 with the paper. Both the corner device locator 26 and the paper aligner 28 are secured to a stapler 30 before use.

The corner device locator 26 has attachment means in the form of two legs 32 extending perpendicularly from either side of a receiver portion 34, defining a short channel that is located about the underside of the magazine 36 of the stapler 30 in use. The two legs 32 may be inwardly biased to maintain a tight fit around the magazine 36 once installed. In this example embodiment the two legs 32 are located toward the back end of the corner device locator 26. The corner device locator 26 also has a central internally protruding stop 37 that complementally fits with the locating slit 20 of the corner device 10. The stop 37 limits the movement of the corner device in the short channel. It would be appreciated that the attachment means of the corner device locator 26 could also be a rivet for holding the corner device locator 26 in place on the stapler 30.

To increase the ability of the corner device locator 26 to hold the corner device 10 in place, a securing formation 38 is centrally located on a front end of the receiver portion 34. Typically the securing formation 38 may be a protrusion (as shown in FIG. 4*b*) or rib that extends into the short channel formed by the two legs 32 and the receiving portion 34 of the corner device locator 26. This protrusion 38 is slipped along the locating slit 20, until the ends of the lobes abuts the back of the receiving portion 34, with the protruding stop 37 extending into the locating slit 20. The securing formation 38 acts as a friction grip to hold the locating formation 14 in position by closely abutting an area adjacent the locating slit 20 and the neck 18.

Also shown in FIG. 4*b* is that the corner device locator 26 is installed towards the front end of the magazine 36, to ensure that the corner device 10, when held by the corner device locator 26, is positioned to allow the legs of a staple to pass through the narrow channels 18 when the stapler 30 is actuated.

The corner device locator 26 is typically manufactured from metal, a resin, plastic material or any other material that could be secured to the magazine 36 of the stapler 30 and that could hold the corner device 10 in place.

The paper aligner 28 comprises two upright brackets 40 with a base 41, the base of the paper aligner 28 being secured to the base 42 of the stapler 30. The outer side of the base 41 typically lies adjacent the edge of the base 42 of the stapler 30. Each of the upright brackets 40 is angled at approximately 45° with a central axis extending longitudinally through the paper aligner, as indicated in FIG. 2. The outer sides of the paper aligner are parallel to the central axis and, to simplify the attachment of the paper aligner 28 to the stapler 30, the outer sides are placed on the respective edges of the base 42 of the stapler 30. The two brackets 40 define an aligning cavity 48, being a right-angled cavity, to receive the document. It will be appreciated that different paper aligners may be used, such as aligners with movable parts allowing a change in the angle of alignment.

Figure 3:
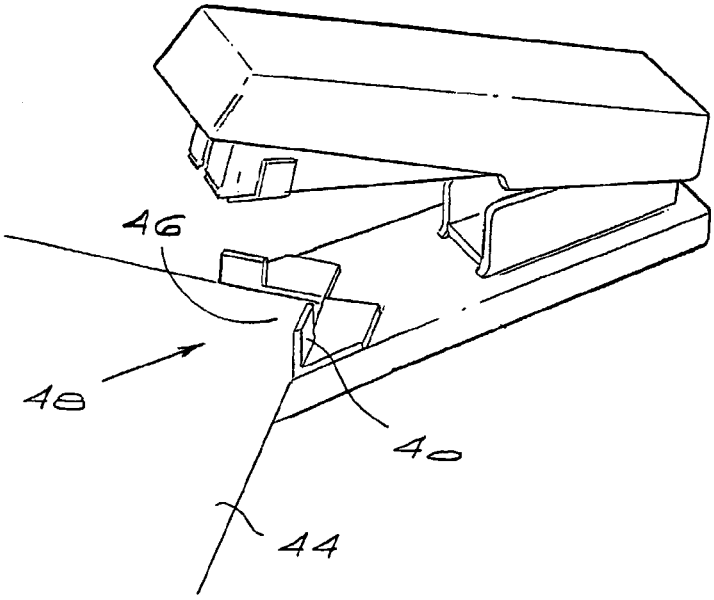
FIG. 3 shows sheets of paper aligned by the paper aligner of FIG. 2.

The steps of attaching the corner device 10 to the sheets of paper will now be discussed according to FIGS. 2 to 6. In FIG. 2 a stapler 30 is shown with the corner device locator 26 and the paper aligner 28 secured to the stapler 30. FIG. 3 shows sheets of paper 44 aligned at an approximate angle of 45° with the stapler 30, by placing corners 46 of the sheets of paper 44 in the aligning cavity 48 defined by the two brackets 40. As shown in FIGS. 4*a* and 4*b* the corner device 10 is now placed in the corner device locator 26, by sliding the locating formation 14 between the space defined by the underside of the magazine 36 of the stapler 30 and the receiving portion 34 of the corner device locator 26. As described, the securing formation 38 travels in the locating slit 20 until it abuts an area adjacent the locating slit 20 and the neck 18, thereby acting as a friction grip. The protruding stop 37 now extends into the locating slit 20, with the securing formation 38 and protruding stop 37 holding the corner device 10 in place while also aligning the corner device 10 with relation to the stapler 30.

In FIG. 5 the corner device 10 has been attached by a staple 50 to the sheets of paper 44. As will be appreciated the staple is attached to the sheets of paper 44 by actuating the stapler 30, with the legs of the staple 50 being forced through the paper on either side of the narrow channel 18 of the corner device 10. The two legs of the staple 50 have thus been received by the two narrow channels 18, thereby allowing the corner device 10 to be attached to the paper 44 without puncturing it. Each locating lobe 22 extends beyond the staple 50, thereby ensuring that the corner device 10 is held in place by the staple 50.

As shown in FIG. 6, the main body 12 of the corner device 10 is now folded or bent over the staple 50 and the locating formation 14 to locate the corner device 10 over the corner of the sheets of paper 44. The neck 16 of the locating formation 14 forms a folding area which makes it easier to fold the main body 12 back over the locating formation 10.

Typically, the upper surface 52 of the main body 12 of the corner device 10, as shown in FIG. 6, carries information or a decorative or ornamental design or pattern that is displayed to a user when the corner device 10 is folded over itself. An example of a decorative pattern that may be carried on the upper surface 52 of the main body 12 is a company logo. Such a logo attached to a document would immediately inform the receiver thereof that the specific company has issued the document. Alternatively, information such as "Contract" or "Legal Document" may be printed on the corner device 10 thereby to indicate the type of document the corner device 10 is attached to. As mentioned, the shape of the main body 12 of the corner device 10 may also be adapted according to the needs of a user.

The corner device 10 is typically made from a durable material such as a metal foil, a resin, a plastics material, or any other material that can bend or can be folded onto itself. It will be appreciated that the locating formation 14 and the main body 12 may be manufactured from the same material, or that the locating formation 14 may be a separate body that could be attached to the main body 12. Alternatively, the corner device 10 may be manufactured from a sheet material forming the locating formation 12 to provide a material that is easy to fold or bend over, whereas the main body may include another layer of material fixed to the sheet material to form an upper surface carrying either the decorative design or the other information. Typically, this further layer will be manufactured from a durable material.

Figure 7:
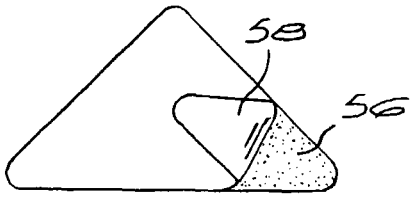
FIG. 7 shows the adhesive layer and backing paper which are applied to the main body of the corner device of FIG. 1.
Figure 8:
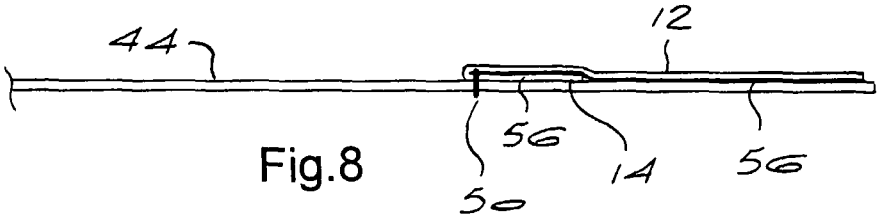
FIG. 8 shows a cross-sectional view of the corner device of FIG. 1 once the main body has been folded over the locating formation.

To secure the corner device 10 to the sheets of paper 44 the bottom surface or underside 54 of the main body 12 of the corner device 10 typically has attachment means, such as an adhesive layer 56 applied to it. Backing paper 58 covers the adhesive layer 56 before it is applied to a surface. Once the corner device 10 is secured to the sheets of paper the backing paper 58 as shown in FIG. 7 is removed, the main body 12 is folded back on the locating formation 14 and the main body 12 is then adhered to the top sheet of the sheets of paper 44 with the locating formation 16 now being between the main body 12 and the sheets of paper 44. The combination of the locating lobes 22 extending beyond the ends of the stapler 50, combined with the adhesive layer 56 on the underside 54 of the main body 12 provides a tamper evident corner device 10 used as a seal. This is best shown in FIG. 8 where the adhesive layer 56 of the main body 12 adheres the locating formation 14 in place beneath the main body, with the staple 50 at the end of the device.

To ensure proper application of the corner device 10 to the sheets of paper 44, it would be appreciated that the corner device 10 should always be fed into the corner device locator 10 with its upper surface 52 facing towards the sheets of paper 44, while the underside 54 with the adhesive layer and backing paper faces away from the sheets of paper. As described above, once the corner device 10 is secured to the paper 44, the main body 12 is folded over the locating formation 14 with the upper surface 52 facing upwards.

Figure 9:
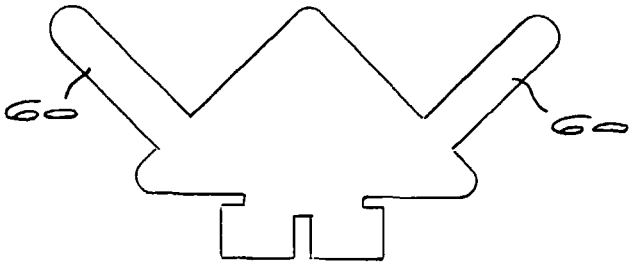
FIG. 9 shows a further example embodiment of the corner device according to the present invention with arms extending from the main body of the corner device.
Figure 10:
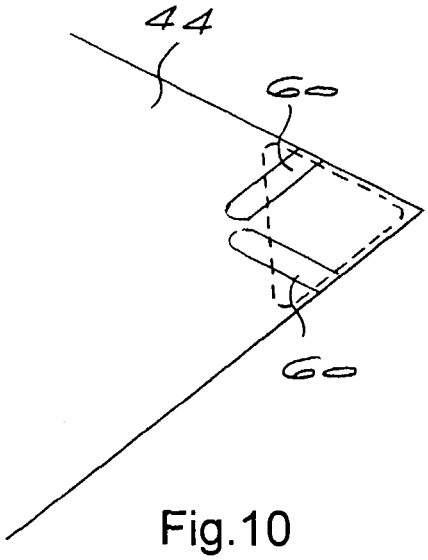
FIG. 10 shows the further embodiment according to FIG. 9 secured to sheets of paper, with the arms of the corner device adhered to the underside of the last sheet of paper.

As best shown in FIG. 9 the main body 12 of the corner device 10 may have two arms 60 shaped and configured to extend radially outward from the main body 12. Typically the two arms 60 would have the same adhesive layer and backing paper on its underside. The two arms 60, once secured to the sheets of paper, further improve the security features the corner device 10. Once the corner device 10 is attached to the sheets of paper 44, the backing paper is removed from the main body 12 and the arms 60 and the main body 12 is adhered to the front page of the sheets of paper. The arms 60 are then folded around each respective side of the corner of the sheets of paper 44 and adhered to the back of the last sheet of the document, as shown in FIG. 10. The arms 60 thereby effectively keep the sheets of paper together. Provided that the sheets of paper 44 and the corner device 10 are correctly aligned with respect to each other, the arms 60 could cover the crammed-back legs of the staple protruding from the last sheet, further providing a tamper-evident seal.

It would be appreciated that only one arm may be used and that the arm or arms may be of any shape or configuration, provided that the arm can be folded around the corner of the sheets of paper thereby keeping the ends of the sheets of paper together.

In instances where the main body 12 does not comprise arms 60, a separate sticker may be adhered over the crammed-back legs of the staple protruding from the last sheet, thereby also providing a tamper-evident corner device. This separate sticker may be of any shape or size, provided that it covers the crammed-back legs of the staple.

Further security features may be included into the corner device 10 by incorporating an electronic device into the main body 12. For example, a transponder may be integrally manufactured or secured to the main body. In circumstances where RFID tags are used as electronic devices, the tags of the documents to which corner devices are attached could be assigned certain parameters like expiration date, permitted movement, and persons authorized to see it. This would also assist in the location of documents. It will be appreciated that a database could be created to establish an audit trail of the handling and workflow history of each document.

Also, in circumstances where a RFID tag forms part of the main body and a photocopier contains a RFID reader, the copying of the document to which the corner device is secured may be prevented. The RFID reader would detect the RFID tag of the corner device and would then not proceed with the photocopy process.

FIG. 11 shows a further example embodiment of a corner device 62 according to the invention, with the corner device 62 having a locating formation 64 and a main body 66 with a hectagonal shape. The main body 66 carries the Seal of the United States. The locating formation 64 of this embodiment has a neck 68 connecting the locating formation 64 with the main body 66. A channel 70 is defined on either side of the neck 68 and the neck 68 also forms a folding area 72. As described above, the folding area 72 makes it easier to fold the main body 66 over the locating formation 64, once the corner device 62 has been attached to a document. The folding area 72 also ensures that the main body 66 is folded at an appropriate angle with the locating formation 64. Two arms 74 extend radially outwards from two of the sides of the main body 66. In use, the arms 74 are folded over the sides of a corner of the document and secured to the back of the last sheet of the document. It will be appreciated that attachment means such as an adhesive layer may also be used in this embodiment of the invention.

FIGS. 12*a* and 12*b* show a corner device locator 76 according to a further example embodiment of the invention. The corner device locator 76 has a receiver portion 78 for receiving the corner device and attachment means in the form of two legs 80 extending perpendicular from the receiver portion 78. The two legs 80 are located towards the front end 82 of the corner device locator 76, thereby creating, with the receiving portion 78, a channel that is located about the underside of a magazine of a stapler 98 to receive the locating formation 64 of the corner device 62. As best shown in FIG. 14, the locating formation. 64 substantially fits into this short channel and abuts a protruding stop. In this example embodiment the stop is a step formation 84 which extends to the back end 86 of the corner device locator 76. The front end 82 of the corner device locator 76 forms a lip 88 to provide easy access for the corner device 62 to the short channel defined by the receiving portion 78 and legs 80.

A further example embodiment of the paper aligner 90 is shown in FIGS. 13*a* and 13*b*. The aligner 90 includes a triangular base 92 extending into two upright brackets 94, with the brackets angled to centrally receive the corner of a document. On the bottom side of the triangular base 92 a connector 94 is provided to secure the paper aligner 90 to the stapler. FIG. 14 shows a stapler 98 with a paper aligner 90 and a corner device locater 76 secured to the stapler. The corner device locator 76 is shown with the corner device 62 received by the short channel of the corner device locator 76. As described above, the paper aligner 90 receives the sheets of paper and aligns the document prior to the corner device 62 being secured to the document.

FIG. 15 shows a further embodiment of a corner device 100 according to the present invention, the corner device 100 having a locating formation 102 and a main body 104. The locating formation 102 is an extension of the main body 104 and does not have any particular locating or aligning features. The width of the locating formation 102 is typically selected to be less than the distance between the two legs of a stapler, thereby ensuring that the stapler does not puncture the corner device 100. This corner device 100 also has a folding area 106 at the base of the locating formation 102 which allows the main body 104 to be easily folded over the locating formation 102 once the corner device 100 has been attached to the article.

Typically, this corner device 100 is slotted into the end portion of a magazine of a stapler, which would hold the corner device 100 in place during the stapling process. Alternatively, a corner device locator similar to the corner device locator 76 shown in FIGS. 12*a* and 12*b* may be used with this corner device. Such a corner device locator 76 would also comprise attachment means to secure it to the stapler.

Apart from the differences in the locating formations of the corner devices, the corner device 100 according to this embodiment would typically include the same features as described under the other embodiments. The features of arms extending from the main body and an adhesive layer on the one side of the main body, is particularly advantageous in this embodiment, as the locating formation 100 does not have lobes or channels to retain the corner device 100 after a staple has attached it to sheets of paper.

It would further be appreciated that other embodiments of the present invention may be developed, in particular an embodiment where the corner device is secured to the side of sheets of paper and not to the corner of the sheets of paper. In such a case the device would typically comprise an elongate main body with at least two locating formations which would receive the staples in use. A paper aligner would align a stapler at a right angle with the side of the sheets of paper to which the corner device has to be attached.

Once the corner device is secured to the sheets of paper with the staple and the adhesive layer, it would be difficult to remove the staple from the sheets of paper without damaging the corner device. To remove the staple, one would first have to detach the main body from the sheets of paper. Provided that a strong adhesive is used, this would result in sheets of paper tearing. The main body can also be manufactured from a material that would disintegrate or tear when the main body is removed from the sheets of paper. Also, where the main body has two arms which are secured to the back of the last sheet of paper, these arms will also have to be detached from the sheets of paper, further destroying the corner device and thereby indicating that the corner device and document have been tampered with.

The invention claimed is:

1. A corner device including:

a main body; and a locating formation extending from one end of the main body and defining a folding area at the one end of the main body, the locating formation shaped to be received by a corner device locator of a stapler to locate and align the corner device with respect to an article and a stapler before attaching the corner device to the article, the locating formation including a shaped portion to receive legs of a staple such that a distance between the legs of the staple is greater than a width of the shaped portion of the locating formation, such that when in use the corner device is attached to the article by a staple at the shaped portion such that the corner device is not punctured by the staple, wherein the folding area is adapted to allow the main body to be folded back at the folding area over the locating formation after the corner device has been attached to the article.

2. A corner device according to claim 1 wherein the shaped portion includes a neck connecting the locating formation with the main body, the folding area forming part of the neck, wherein the locating formation and the main body define a narrow channel on either side of the neck, the narrow channel operable to receive the legs of the staple.

3. A corner device according to claim 1 wherein the locating formation further includes two lobes defining a central locating slit which extends from an outer end of the locating formation towards the main body, the two lobes extending beyond the staple to ensure that the corner device is held in place by the staple.

4. A corner device according to claim 1 wherein the main body has attachment means to secure a bottom surface of the main body over the locating formation and to the article.

5. A corner device according to claim 4 wherein the attachment means is an adhesive layer applied to the bottom surface of the main body.

6. A corner device according to claim 1, wherein the main body further includes at least one arm shaped and configured to extend radially outward from the main body, the at least one arm having a bottom surface to which an adhesive layer is applied, wherein, in use, the at least one arm is folded around a side of the article to secure the arm to a back of the article.

7. A corner device according to claim 6 wherein the main body includes two arms.

8. A corner device according to claim 1, wherein the main body includes a security apparatus.

9. A corner device according to claim 8 wherein the security apparatus is an electronic device.

10. A corner device according to claim 1, wherein the information on the upper surface of the main body identifies the article to which the corner device is attached.

11. A corner device according to claim 1, wherein the ornamental pattern on the upper surface of the main body is a company logo or emblem.

12. A corner device according to claim 1, wherein the article comprises sheets of paper.

13. A corner device locator for securing a corner device as claimed in claim 1 to an article, the corner device locator including a receiver portion and attachment means for attaching the corner device locator to a stapler, wherein the receiver portion defines a short channel that is located, in use, about the underside of a magazine of the stapler, the short channel in use to receive a locating formation of the corner device thereby to align and hold the corner device in place and to allow the legs of a staple to pass on either side of the locating formation when the stapler is actuated.

14. A corner device locator according to claim 13 wherein the attachment means is two legs extending perpendicularly from either side of the receiver portion, the legs being biased towards each other to grip the magazine of the stapler.

15. A corner device locator according to claim 13 wherein the locator further includes a central securing formation on a front end of the receiver portion to hold a corner device in place.

16. A corner device locator according to claim 15 wherein the securing formation is a protrusion.

17. A corner device locator according to claim 13 wherein the locator includes a stop to limit the movement of a corner device in the short channel.

18. A corner device locator according to claim 17 wherein the stop is a central internally protruding stop, which, in use, is received by a central locating slit of the corner device.

19. A corner device locator according to claim 17 wherein the stop is defined by a step formation between a front end and a back end of the locator, against which, in use, the locating formation of the corner device abuts.

* * * * *